United States Patent [19]

Vining et al.

[11] 4,279,711

[45] Jul. 21, 1981

[54] AQUEOUS ELECTROWINNING OF METALS

[76] Inventors: Paul H. Vining, 1220 Lee Dr., Coraopolis, Pa. 15108; Jack A. Scott, 456 Riverside Dr.; Paul F. Duby, 560 Riverside Dr., both of New York, N.Y. 10027

[21] Appl. No.: 113,761

[22] Filed: Jan. 21, 1980

[51] Int. Cl.[3] ..... C25C 1/00; C25C 1/08; C25C 1/12; C25C 1/16

[52] U.S. Cl. ..... 204/105 R; 204/108; 204/119

[58] Field of Search ..... 204/105 R, 106, 118, 204/119, 108

[56] References Cited

U.S. PATENT DOCUMENTS

| | | | |
|---|---|---|---|
| 598,180 | 2/1898 | Hoepfner | 404/212 |
| 3,103,474 | 9/1963 | Juda | 204/104 |
| 3,772,003 | 11/1973 | Gordy | 75/101 R |
| 4,056,449 | 11/1977 | De Nora | 204/106 |
| 4,178,218 | 12/1979 | Seko | 204/98 |

OTHER PUBLICATIONS

Ind. Chim. Belge Suppl., vol. 1, pp. 777–781, 1959.

ATB Metallurgie, Mons, Belgium, vol. X, No. 4, 1970, pp. 113–124.

J. of Metals, vol. 27, No. 12, p. A53, 1975.

Chemical Abstracts, vol. 87, 1977, 87:42299f.

*Primary Examiner*—T. M. Tufariello

*Attorney, Agent, or Firm*—Brumbaugh, Graves, Donohue & Raymond

[57] ABSTRACT

An improved process for aqueous electrowinning of metals, using methanol (or another soluble fuel) added to the electrolyte, a catalytically active platinum mesh or platinum-plated titanium anode and periodic current reversal, in order to maintain a low anodic potential, and hence, a cell voltage and energy consumption lower than in conventional processes. Examples illustrate the electrowinning of zinc and copper from sulfuric acid-sulfate electrolytes, but the process applies to other metals. Also disclosed is the use of an ion-exchange membrane in combination with the above features, in order to decrease the loss of fuel from the anolyte and to minimize the effect at the anode of impurities present in the catholyte.

15 Claims, No Drawings

AQUEOUS ELECTROWINNING OF METALS

Electrowinning from aqueous solutions using insoluble anodes is a well-established process for metals like zinc, copper, nickel, cobalt, cadmium, manganese and others. The metal is electrodeposited at the cathode from a solution of one of its salts, most commonly a sulfate. Water is decomposed at the anode, usually made of lead or a lead alloy; oxygen is evolved and acid (hydrogen ions) is formed. The electrowinning reactions may be described generally by the following (wherein M represents any of the metals mentioned above):

| | |
|---|---|
| Cathode: | $M^{++} + 2e \rightarrow M$ |
| Anode: | $H_2O \rightarrow \frac{1}{2}O_2 + 2H^+ + 2e$ |
| Overall Reaction: | $M^{++} + H_2O \rightarrow \frac{1}{2}O_2 + 2H^+ + M$ |

For a sulfate solution, the overall reaction can be written:

$$MSO_4 + H_2O \rightarrow \tfrac{1}{2}O_2 + H_2SO_4 + M$$

The minimum electrical energy consumption for the electrolytic process is proportional to the reversible electromotive force (emf). The actual energy used corresponds to the operating cell voltage which is the sum of the reversible emf plus irreversible potential differences, namely the ohmic drops, and the anodic and cathodic overpotentials. Typical voltage components, as disclosed by A. R. Gorden, "Improved Use of Raw Material, Human and Energy Resources in the Extraction of Zinc," in *Advances in Extractive Metallurgy* 1977, edited by Jones, M. J., Institution of Mining and Metallurgy, London, p. 158, of a zinc electrolysis cell are as follows:

| | Volts |
|---|---|
| Reversible cathode potential vs. SHE | −0.819 |
| Cathode overvoltage | −0.062 |
| Addition agent effect, etc. | −0.001 |
| Cathode potential, sum of above three | −0.882 |
| Reversible anode potential vs. SHE | +1.217 |
| Oxygen overvoltage | +0.84 |
| Addition agent effect, etc. | −0.216 |
| Anode potential, sum of above three | +1.841 |
| Anode scale potential drop | 0.15 |
| Electrode potential drop | 0.594 |
| Total ohmic effect, sum of above two | 0.744 |
| Total cell voltage | 3.467 |

| Conditions: | |
|---|---|
| Cathode current density | 526 A/m$^2$ |
| Zinc in electrolyte | 44 g/l |
| $H_2SO_4$ in electrolyte | 99 g/l |
| Mn in electrolyte | 11 g/l |
| Co in electrolyte | 10 mg/l |
| Pure lead anodes | |
| Addition agents | |
| Glue | 25 mg/l |
| Beta-naphthol | 25 mg/l |
| Sb | 0.15 mg/l |
| Electrode spacing | 3 in cathode centre-cathode centre |

| | |
|---|---|
| Cathode: | $3M^{++} + 6e \rightarrow 3M$ |
| Anode: | $CH_3OH + H_2O \rightarrow CO_2 + 6H^+ + 6e$ |
| Overall Reaction: | $CH_3OH + H_2O + 2M^{++} \rightarrow 3M + CO_2 + 6H^+$ |

The actual energy use is also inversely proportional to the electrochemical current efficiency. In a typical modern plant, the average current efficiency is 90% and the energy consumption is 1.4 kWh/lb. Zn.

In order to reduce these energy requirements, there has been developed according to the present invention a method of electrowinning metals employing a fuel which can react electrochemically at the anode. This improved method includes the use of a catalytically active anode (necessary to promote the fuel-electro-oxidation) as well as the use of periodic current interruption (PCI) or, preferably, periodic current reversal (PCR) in the electrolysis cell.

The invention preferably also includes but does not require the use of a diaphragm or an ion-exchange membrane to separate the anolyte from the catholyte thereby allowing a higher concentration of the fuel near the anode, where it is used, than near the cathode. The diaphragm or membrane also decreases the transport to the cathode of catalyst (e.g. platinum) which could be removed from the anode, and the transport to the anode of impurities (e.g. chloride ions) in the catholyte which could hinder the fuel oxidation.

According to the present invention, the oxidation of water at the anode in conventional systems is replaced by the oxidation of a fuel, preferably one which is soluble (e.g. methanol) or which may be dispersed in the electrolyte (e.g. hydrogen). The oxidation of methanol proceeds with the evolution of carbon dioxide gas and the formation of acid (hydrogen ions) from the fuel and water. The reactions involved may be summarized as follows:

| | |
|---|---|
| Cathode: | $3M^{++} + 6e \rightarrow 3M$ |
| Anode: | $CH_3OH + H_2O \rightarrow CO_2 + 6H^+ + 6e$ |
| Overall Reaction: | $CH_3OH + H_2O + 3M^{++} \rightarrow 3M + CO_2 + 6H^+$ |

As indicated by the following, the anode reaction has a lower reversible emf than that involving water oxidation, and its minimum energy requirement is accordingly lower.

(a) Traditional zinc electrolysis (water oxidation)

$$2H_2O \rightarrow O_2 + 4H^+ + 4e \qquad E^\circ = 1.229\ V$$

(b) Proposed Zinc electrolysis with $CH_3OH$ addition $$CH_3OH(aq) + H_2O \rightarrow CO_2 + 6H^+ + 6e \qquad E^\circ = 0.043\ V$$

Reduction in reversible emf: 1.186 V

Taking the typical conventional cell voltage figure above of 3.467, the reduction in voltage relative to the total cell $$\text{operating voltage} = \frac{1{,}186}{3{,}467} \times 100 = 34\%.$$

Methanol is characterized here as a fuel because it is oxidized at the anode. This reaction is similar to the anodic reaction of a fuel cell. As is known and documented in the fuel cell art, the reactivity of methanol in acid media is low and a catalytic electrode surface is needed for the reaction to proceed at acceptable rates. The only suitable catalysts found so far are the platinum class metals. Even these metals, however, have contributed to limited success in the past. It is generally agreed that there is a "poisoning" reaction which occurs at the platinum anode, greatly reducing the active sites of methanol oxidation. This "poisoning" reaction is understood to be one of a combination of (1) the adsorption of an intermediate product in the oxidation of $CH_3OH$, (2), the adsorption of a side product, or (3) the formation of a platinum oxide on the electrode surface.

According to the present invention, the adverse effects of this "poisoning" reaction at the anode is substantially corrected or prevented by periodically interrupting or, preferably, reversing the direct electric current in the electrolysis cell. Thus the anodic sites which have been or otherwise would be rendered inactive by the poisoning reaction are maintained in a catalytically active state. It is contemplated that the PCI or PCR cycle be relatively short—e.g. 30 seconds to about 10 minutes—so as to maintain a relatively constant, and desirably low, cell voltage. In other words, a feature of the present invention is the discovery that PCI or PCR may be used to maintain the low cell voltages otherwise obtainable for only short periods with fuels such as methanol. Also, while PCI and PCR are both disclosed in the context of the present invention, PCR is definitely preferred.

In this regard, work has been done in the past—e.g. as disclosed by Duby, "Reducing the Specific Energy Consumption in Zinc Electrowinning," Ind. Chim. Belge, Suppl., Vol. 1, pp. 777–781, 1959 and Vereecken et al., "Contribution to the Study of Anodic Oxidation of Methanol in Sulfuric acid in Relation to its Use for Decreasing the Energy Consumption in Zinc Electrowinning," ATB Metallurgie (Mons, Belgium), Vol. X, No. 4, pp. 113–124, 1970—involving the use of fuels such as formic acid or methanol together with current interruption (as opposed to periodic current reversal). This work did not result, as is the case with the present invention, in a method whereby the electrolysis cell could be maintained at a low voltage for substantial lengths of time. To the contrary, the electric current was applied unidirectionally until the poisoning reaction at the anode caused the cell voltage to rise to unacceptable levels. At this point the system was shut down—i.e. the current was interrupted—to permit the anode to be regenerated. After the anode was regenerated current was applied until the system again became inoperative. Significantly, there was also a rapid decline in the ability of the anode to become regenerated with the result that even the initial low-high voltage cycle could not be maintained for any substantial length of time.

The use of PCI or PCR in the context of the present invention is also to be distinguished over prior methods wherein PCR was used in electroplating and electrorefining, and was suggested for use in conventional zinc electrowinning to improve the cathode deposit and thereby to operate at higher current densities. Such methods did not take advantage of a fuel-oxidation reaction at the anode and hence were unrelated to the maintenance of anode activity.

The present invention may be illustrated by the following exemplary data. Methanol, either anhydrous (99.5%) or as an aqueous mixture, or another preferably soluble fuel, is added to the electrolyte. This is preferably accomplished just before the electrolyte enters the electrolysis tank or in the tank itself. It can also be added after the leaching, during one of the purification stages, or in the electrolyte storage reservoir. The methanol feed rate is such that its concentration in the electrolyte tank is no less than about 0.1 M (3.2 g/l) and preferably in a range of about 0.2 to 1.0 M, but it can be higher. The zinc concentration is as in a conventional process, typically about 40 g/l up to saturation (about 220 g/l).

If a diaphragm or an ion-exchange membrane is used, then the methanol is added to the anolyte and its concentration can be controlled more easily. In order to decrease losses, it is preferred that the methanol concentration be kept closer to the lowest value at which the fuel electro-oxidation can be maintained.

The anode is made of an electrically conducting material which does not react under aqueous acid oxidizing conditions and which has a catalytically active surface. For instance, while platinum class metals and alloys make suitable catalysts, graphite or titanium can be used as a substrate with platinum class metal and alloy surfaces. Other commercially available electrodes can also be used such as those known in the trade as "dimensionally stable anodes" (DSA).

The PCI or PCR cycle duration can vary from a few seconds to several minutes or longer. As was explained above, the important consideration here is that the overall cell voltage be maintained at a relatively consistently low level—i.e. it is not desired that the anode be permitted to become poisoned to a substantial degree before the current is interrupted or reversed.

The actual cycle duration utilized in any particular application will depend largely upon the system parameters, particularly upon the type of anode used. In large commercial applications, it is contemplated that anodes can be employed that will maintain substantially high and relatively constant catalytic activity for several (e.g. up to 10) minutes before a few seconds of PCR need be applied. It is thus not contemplated that a cycle duration of less than 30 seconds, and preferably one minute, will be necessary or desirable while a duration of longer than 10 minutes and more likely 5 minutes may not be obtainable. The preferred cycle time is, therefore, from 30 seconds to 10 minutes and preferably from 1 to 5 minutes.

It will also be appreciated by one skilled in the art that the duration of current reversal or (optionally but not preferred) interruption should be as short as possible (consistent with the maintenance of anodic activity) compared to duration of the electrowinning direct current since the reversal period wastes energy and detracts from the overall metal recovery. It is therefore suggested that the period of reversal or interruption be less than 10% of the overall cycle and preferably less than 5%. Indeed, it is contemplated that with high quality anodes, reversals or interruptions of 1% or less may prove sufficient.

It will be appreciated from the above that while it is a stated object of the invention to maintain relatively constantly high anodic activity and hence a low cell voltage, there may be a relatively slight cell voltage rise during the PCR or PCI cycle. What is to be avoided are the relatively drastic voltage fluctuations such as would occur when the methanol-oxidation is substantially replaced by the water oxidation reaction. Put another way, it is an object of the invention that the reaction at the anode be substantially limited to the fuel electro-oxidation.

An ion-exchange membrane can be used to separate the anolyte containing the methanol or other fuel from the catholyte. As a cation-exchange membrane, for instance, there can be used a perfluorosulfonic acid resin which has a transport number for hydrogen ion close to unity and a low electrical resistance. The "Nafion®" membranes available commercially are suitable. An anion-exchange membrane or a porous diaphragm may not be as effective, but they may be useful in some instances.

EXAMPLE I

A batch zinc electrowinning experiment was carried out in a one-liter beaker with a 10 $cm^2$ aluminum cathode and a 10 $cm^2$ platinized platinum mesh anode, separated by 3.5 cm. The anode was prepared by the following procedure: (a) cleaning in aqua regia, then in nitric acid, and then by cathodic hydrogen evolution in sulfuric acid; (b) platinizing in chloro-platinic acid with a current of 100 mA for 3 minutes, 200 mA for 3 minutes and 500 mA for 5 minutes. The electrolyte was a solution containing 65 g/l Zn, 100 g/l $H_2SO_4$ and 32 g/l $CH_3OH$. The electrodes were mounted in a Plexiglass holder which ensured that the electrodes remained parallel to each other and that the current was efficiently and evenly distributed. The holder was also provided with suitable openings to allow for circulation (e.g. by natural convection) of the electrolyte.

Electrolysis was carried out by passing a current of 400 mA for 3.5 minutes at about 24° C. By means of mechanical timers and switches, the current was periodically reversed according to a cycle of 60 seconds forward current followed by 2.5 seconds reverse current. The average anode potential was 0.64 V (relative to a standard hydrogen electrode (SHE)), the cell voltage was 1.9 V and the current efficiency was 87.1%. This yielded an electrical energy consumption of 0.81 kWh/lb. Zn.

Comparative Example Ia

Another experiment was carried out under the same conditions as those of Example I except for the fact that the current was 350 mA and it was not reversed. The anode potential started rising to about 0.8 V (SHE) in about 30 minutes and then to 1.8 V (SHE) a few minutes later. By interrupting the current briefly, the anode potential was reduced to 0.8 V (SHE), but then it would soon increase again to 1.8 V (SHE) for a cell voltage of about 2.9 V.

Comparative Example Ib

An experiment was carried out under the same conditions as those of Example Ia except for the fact that the electrolyte contained no methanol. The anode potential was 1.86 V (SHE) and the cell voltage was 2.9 V

Comparative Example Ic

An experiment was carried out under the same conditions as those of Example Ib except for the fact that the anode was a sheet of lead instead of a platinized platinum mesh. The anode potential was 2.5 V (SHE) and the cell voltage was 3.5 V.

EXAMPLE II

An experiment was carried out under conditions similar to those of Example I. The anode was made of titanium mesh and it was platinized in a chloroplatinic acid solution as described in Example I. The electrolyte contained 80 g/l Zn, 100 g/l $H_2SO_4$ and 32 g/l $CH_3OH$. A current of 400 mA was passed for 8 hours at 40° C. It was periodically reversed following a cycle of 60 seconds of forward current and 2.5 seconds of reverse current. The average anode potential was 0.7 V (SHE), the cell voltage was 1.93 V, the current efficiency was 86.9% and the energy consumption was 0.83 kWh/lb. Zn.

EXAMPLE III

A copper electrowinning experiment was carried out with an electrolyte containing 40 g/l Cu, 30 g/l $H_2SO_4$ and 32 g/l $CH_3OH$ at 40° C. The anode was a platinized titanium mesh prepared as described in Example I. The cathode was a 13 $cm^2$ titanium sheet. A current of 250 mA was passed for 8 hours. It was periodically reversed with a cycle of 60 seconds forward current and 2.5 seconds reverse current. The average anode potential was 0.71 V (SHE) and the cell voltage was 1.02 V. The current efficiency was 91.8% resulting in an energy consumption of 0.43 kWh/lb Cu (compared to about 1.0 kWh/lb. Cu for the traditional process).

EXAMPLE IV

A batch zinc electrowinning experiment was carried out in a one-liter beaker with a 9.2 $cm^2$ aluminum cathode separated from a platinized titanium anode by a cation-exchange membrane. The anode was a 0.063 in. thick expanded titanium mesh with a diamond-shaped 50% open area. It was coated with about 20 $\mu$in. of a 70/30 platinum/iridium deposit. It was further covered with platinum black by platinization in a chloroplatinic acid solution, using periodic current reversal, with a current of 350 mA for approximately 25 min. The cation-exchange membrane was a Nafion® ion-exchange membrane, series 427, which is a homogeneous film, 7 mils thick of 1200 equivalent weight perfluorosulfonic acid resin laminated with a Teflon fabric. The two electrodes and the membrane were placed in a Plexiglass holder inside the beaker to maintain the electrodes at a distance of 6.8 cm from each other. The membrane was fitted in the center of the holder in such a way that it formed with the anode, the walls and bottom of the holder a closed compartment for the anolyte of about 30 $cm^3$ useful volume. The catholyte compartment was open in order to allow the circulation of the electrolyte in front of the cathode and outside the holder within the beaker. The anolyte was a solution of 32 g/l $CH_3OH$ and 100 g/l $H_2SO_4$. The catholyte had 100 g/l Zn and 100 g/l $H_2SO_4$.

Electrolysis was carried out at 40° C. by passing a current of 400 mA for 4 hours, periodically reversed, following a cycle of 60 seconds forward current and 2.5 seconds reverse current. The average anode potential was 0.64 V (SHE), the potential drop across the membrane was 0.24 V, and the ohmic drops across the anolyte and catholyte were about 0.31 V each. The cell voltage was 2.4 V and the current efficiency was 82.6%, yielding an energy consumption of 1.09 kWh/lb. Zn.

We claim:

1. A method for aqueous electrowinning of a metal, said method including the steps of immersing an anode and a cathode in an electrolyte solution; said solution comprising water, ions of said metal, and a fuel which is soluble or which can be dispersed in the electrolyte and which will be oxidized at the anode; said anode having a catalytically active surface for the promoting of the reaction of said fuel; passing a direct electric current through said solution thereby to deposit said metal on said cathode, and periodically reversing or interrupting said electric current for a period of time less than 10% of the time the electric current is passed in the direction to deposit said metal on said cathode, the time between each of said periodically reversing or interrupting said current being from 30 seconds to 10 minutes so as to cause the reaction at the anode to be substantially limited to the electro-oxidation of said fuel.

2. A method for aqueous electrowinning according to claim 1 wherein said metal is at least one of the group consisting of zinc, copper, nickel, cobalt, cadmium and manganese.

3. A method for aqueous electrowinning according to claim 2 wherein the duration of said periodically reversing or interrupting said current is less than 5% of the time between each of said reversing or interrupting said current.

4. A method for aqueous electrowinning according to claim 2 wherein the time between each of said reversing or interrupting said current is from 1 minutes to 5 minutes.

5. A method for aqueous electrowinning according to claim 2 wherein the fuel is methanol.

6. A method for aqueous electrowinning according to claim 4 wherein the fuel is methanol.

7. A method for aqueous electrowinning according to claim 5 wherein the metal is zinc.

8. A method for aqueous electrowinning according to claim 6 wherein the metal is zinc.

9. A method for aqueous electrowinning according to claim 2 wherein said reversing or interrupting said current is limited to reversing said current.

10. A method for aqueous electrowinning according to claim 9 wherein the step of periodically reversing said current is carried out in cycles of substantially equal duration.

11. A method for aqueous electrowinning according to claim 2 including the step of including in the electrolyte a diaphragm or membrane to separate the anolyte from the catholyte thereby to permit the concentration of fuel in the anolyte to exceed the concentration of fuel in the catholyte.

12. A method for aqueous electrowinning according to claim 5 wherein said methanol is present in a concentration of at least about 0.1 M.

13. A method for aqueous electrowinning according to claim 12 wherein said methanol is present in a concentration of about 0.2 M to about 1.0 M.

14. A method for aqueous electrowinning according to claim 7 wherein said zinc ions are present in a concentration of at least 40 g/l.

15. A method for aqueous electrowinning according to claim 2 wherein said catalytically active surface is selected from the group consisting of platinum class metals and alloys.

* * * * *